United States Patent [19]

Etchell

[11] Patent Number: 4,796,530

[45] Date of Patent: Jan. 10, 1989

[54] OSCILLATING ROLL FOR PRINTING PRESSES

[75] Inventor: Gordon Etchell, Downers Grove, Ill.

[73] Assignee: Pathfinder Graphic Associates Inc., Justice, Ill.

[21] Appl. No.: 56,392

[22] Filed: Jun. 1, 1987

[51] Int. Cl.[4] ..... B41F 31/00

[52] U.S. Cl. ..... 101/349; 101/DIG. 14

[58] Field of Search ..... 101/349, DIG. 14, 348, 101/350, 353, 205, 206, 207, 208

[56] References Cited

U.S. PATENT DOCUMENTS

| | | | |
|---|---|---|---|
| 3,934,508 | 1/1976 | Heinlicher | 101/349 |
| 4,040,347 | 8/1977 | Johne et al. | 101/DIG. 14 |
| 4,458,592 | 7/1984 | Junghans | 101/DIG. 14 X |
| 4,522,123 | 6/1985 | Matsumoto | 101/349 |
| 4,546,701 | 10/1985 | Junghars | 101/DIG. 14 |
| 4,671,175 | 6/1987 | Zimmer et al. | 101/148 |
| 4,753,166 | 6/1988 | Fischer | 101/DIG. 14 X |
| 4,753,167 | 6/1988 | Shriver | 101/348 X |

FOREIGN PATENT DOCUMENTS

| | | | |
|---|---|---|---|
| 463315 | 7/1928 | Fed. Rep. of Germany | 101/349 |
| 2903409 | 8/1979 | Fed. Rep. of Germany | 101/349 |
| 3109584 | 9/1982 | Fed. Rep. of Germany | 101/349 |
| 41964 | 3/1982 | Japan | 101/DIG. 14 |
| 802951 | 10/1958 | United Kingdom | 101/349 |

*Primary Examiner*—David A. Wiecking
*Assistant Examiner*—James R. McDaniel

[57] ABSTRACT

In a drive for the fluid distributing roller of a printing press, the roller, in addition to rotating about its axis, is required to be axially reciprocated. The distributing roller is mounted upon a drive shaft with which it rotates but with respect to which it can be axially reciprocated. A cam is connected to the shaft and is gear-rotated therewith, and through a cam follower, the shaft of the cylinder, while being rotated, is caused to axially reciprocate by the presence of a cam follower operating in the rotating cam.

3 Claims, 2 Drawing Sheets

OSCILLATING ROLL FOR PRINTING PRESSES

BACKGROUND OF THE INVENTION

The present invention relates to printing presses, and in particular, to the device for axially reciprocating a rotary fluid distributing roller used for distributing moisturizing liquid or ink to moisturizing mechanisms or inking mechanisms of printing presses.

Up to the present time, known devices for axially moving such distributing rollers in printing presses have included mostly a cam and lever mechanism, or making use of incline rollers co-acting with supporting rollers which are connected to the distributing roller. Also, use is made of an incline ring which is provided with a keyway in which a small ball rotates while driving a follolwing keyed member.

One disadvantage inherent to these known devices is a defective and non-uniform feeding of moisturized liquid to the moisturized rollers which then, because of the deficiency in the moisturized liquid, takes up printing ink from the printing plate and spoils these locations which are not to be printed. Devices with an axial shiftable distributing roller bring about, as a result of the use of fixedly arranged cams, an undesirable and much too rapid lateral for axial movement. As a result and also as a result of the rotary motion of the distributing roller, the distributing film is defective since the excess of the moisturizing liquid collects at the edge of the roller. Thus, the edge regions of the paper sheet which are printed receive too much moisture.

In particular, during high speed operations, there are, as a result of a voilent axial movement of the roller, large inertial forces which produce periodic impacts of the entire frame of the printing press and have an unfavorable influence on the quality of the printing.

SUMMARY OF THE INVENTION

It is accordingly a primary object of the present invention to provide a construction which would avoid the above-mentioned drawbacks.

One object of the invention is to provide a fluid distributing roller assembly capable of achieving a uniform distribution of a fluid, such as a moisturizing liquid on printing ink.

Another object of the invention is to provide a fluid distributing roller assembly which reciprocates axially in cycles, each of which includes axial movement first in one direction and then in an opposite direction with each of these cycles taking place during several revolutions of the distributing roller so that the axial cycle cyclical movement takes place at a lower speed than the rotary movement of the fluid distributing roller.

According to the invention, the structure includes a drive shaft which supports a hollow fluid distributing roller. While this roller is constrained to rotate with the drive shaft, it is at the same time supported for a free axial movement relative thereto. This drive shaft includes a gear-driven cam hub which rotates with the shaft. By the singular dual-gear drive, a second geared member, including a cam follower, is rotated which will function to effect reciprocal movement axially of the cylinder relative to the drive shaft. Thus, the drive includes a double gear meshing with a pair of additional spur gears in order to achieve the two-stage gear transmission.

BRIEF DESCRIPTION OF THE DRAWINGS

The invention will be best understood by reference to the accompanying drawings which form a part of this application.

DETAILED DESCRIPTION OF THE PREFERRED EMBODIMENTS

Figure 1:
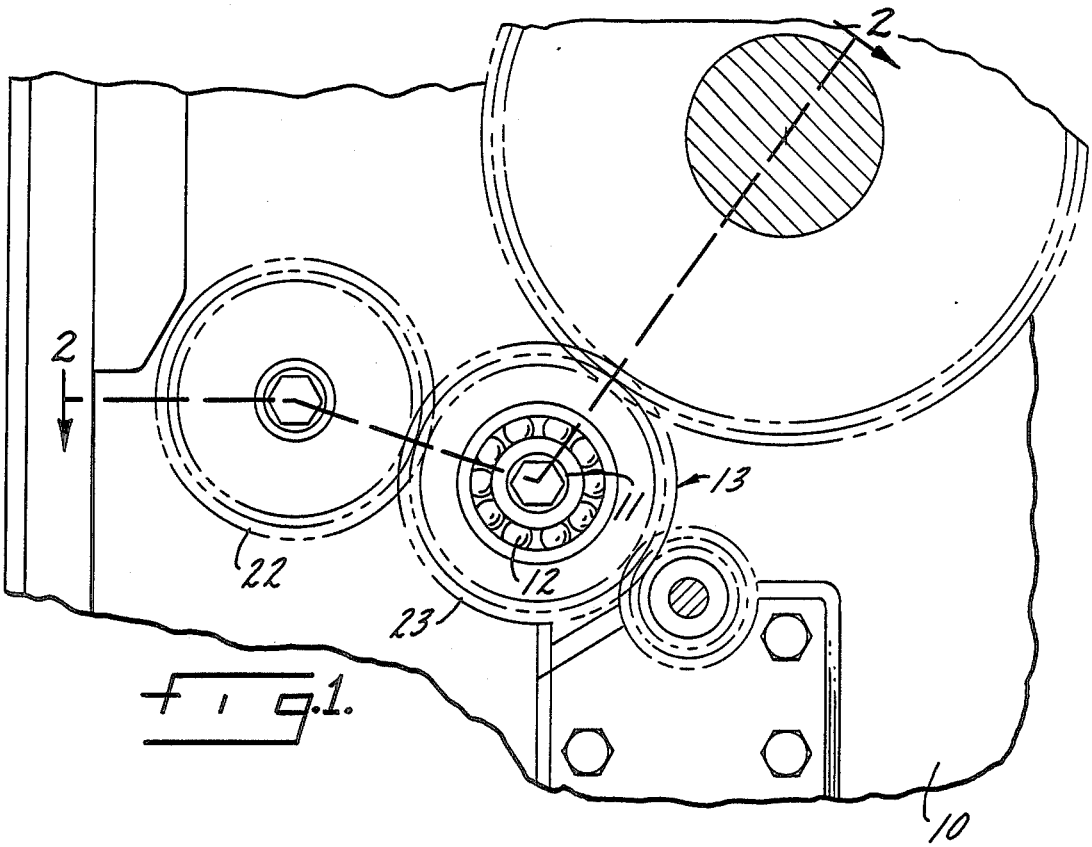
FIG. 1 is a schematic diagram of the relations of the gear and shaft drive cylinders of the invention.
Figure 2:
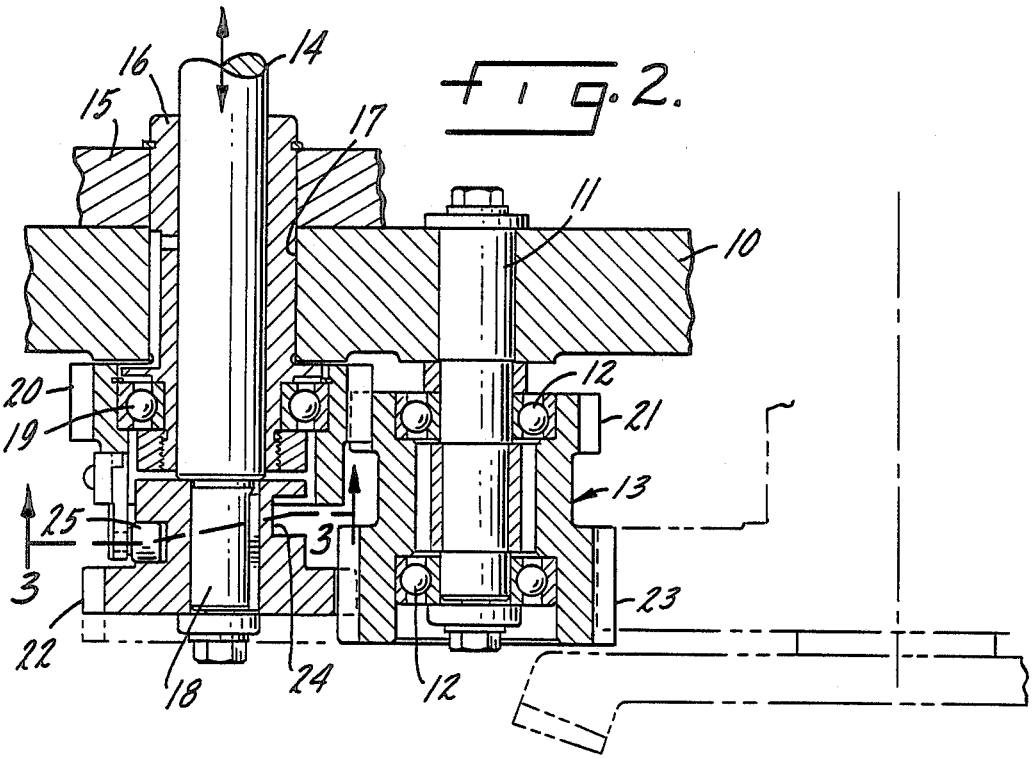
FIG. 2 is a fragmentary detailed sectional view taken on line 2—2 of FIG. 1.

As shown in FIG. 2, a frame section 10 has journaled therethrough a support shaft 11, which in turn is mounted within a lower bearing 12 for rotably supporting a double-drive gear 13.

One end of a cylinder shaft 14 is journaled in a socket assembly 15 mounted on the interior of the frame 10. A bushing 16 is placed within an opening 17 formed in the frame 10, and it in turn supports the protruding end 18 of the shaft 14.

A bearing 19 surrounds the shaft 14 and supports a cam follower drive gear 20, which in turn meshes with the first set of gear teeth 21 provided by the double gear 13.

On the extreme end of the shaft 14 is keyed a barrel cam gear 22, the teeth of which mesh with the second set of gear teeth 23 on the double gear 13.

It should be noted that the gear ratio between the cam follower drive gear 20 and the first set of gear teeth 21 may be in the range of 27/29 to 25/26, while the gear ratio between the barrel cam gear 22 and the second set of gear teeth 23 of the double gear 13 may be 26/26.

The driven cam follower gear 20 and barrel cam gear 22 are thus designed to incorporate variable oscillation, with the water oscillator being slower in motion as compared to the inking cylinder rotation which is a normal function in printing presses.

As seen, the barrel cam gear 22 provides a hub 24 having a cam-type track of a modified trapezoidal type of path formed therein. A cam follower 25 supportd by the cam follower drive gear 20 is adapted to ride in the track 24 for reasons hereinafter made apparent.

Figure 3:
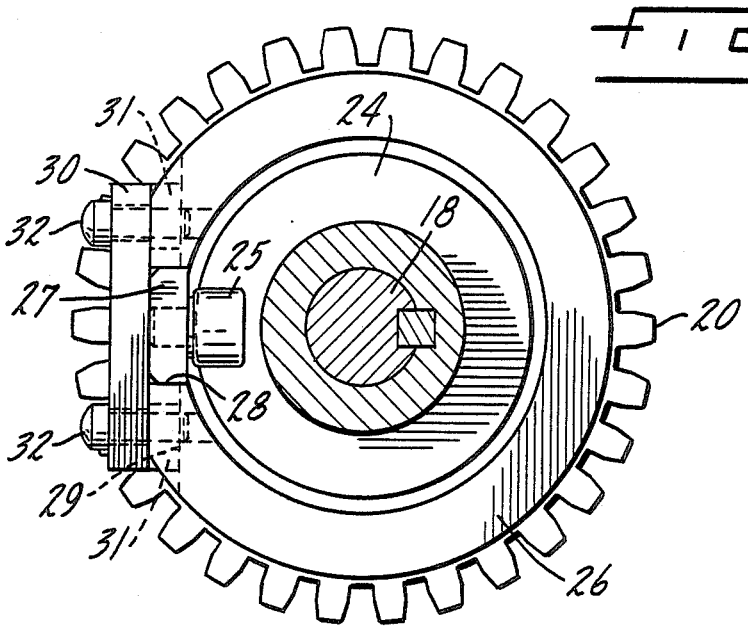
FIG. 3 is a detailed sectional view taken on Line 3—3 of FIG. 2.
Figure 4:
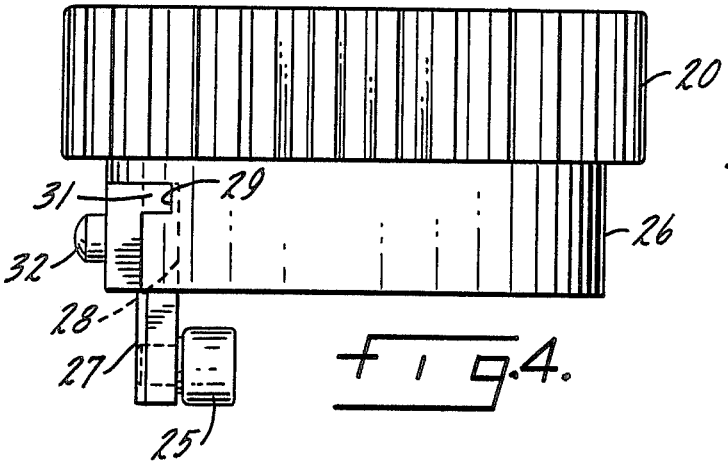
FIG. 4 is a top elevational view of the cam follower and gear base as employed in the invention.
Figure 5:
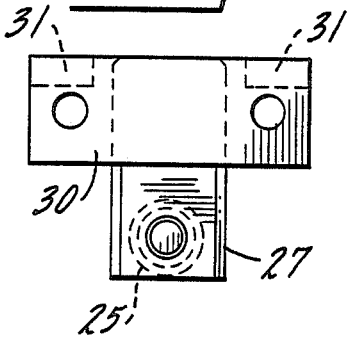
FIG. 5 is a side elevational view of the cam follower as viewed from the left side of FIG. 4.
Figure 6:
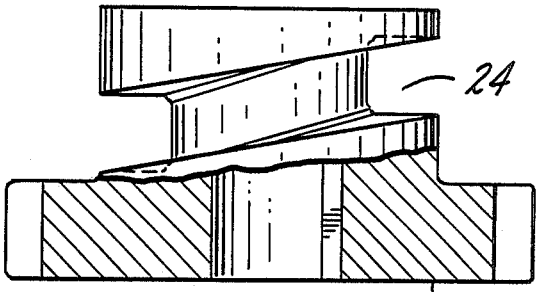
FIG. 6 is a side elevational detailed sectional view of the gear-driven cam hub of this invention.

As shown in FIGS. 3 and 4, the cam follower drive gear 20 is provided with a reduced hub 26 to which is mounted a cam bracket 27, which in turn, rotably supports the cam follower 25.

As seen in FIG. 4, the hub 26 of the cam follower drive gear 20 is notched as at 28 with the notch 28 including a tee head 29.

The bracket 28 provides a curved plate 30 having the same arcuation as is the circumference of the hub 26 so as to be positioned within the notch 28 formed in the hub 26. The plate 30 also provides a pair of lateral inserts 31 which are adapted to be positioned in the tee heads 29 of the slot 28 so as to secure the bracket 27 in a parallel positioned to a center line drawn through the cam follower and drive gear 20. A set of screws 32 will fixedly mount the bracket 27 to the hub 26 and support the roller 25 in its engagement within the cam track 24.

In operation, the double gear 13 is rotated by a drive mechanism not shown and it in turn through its double set of gear teeth 21 and 23 will rotate the cam follower drive gear 20 as well as the barrel cam track 22. As the barrel cam 22 is fixed to the shaft 14 of the cylinder to be oscillated, it is apparent that as the barrel cam gear 22 rotates the cam follower 25, while riding in the cam track 24, will cause these barrel cam gear 22 and the shaft 14 to which it is keyed to, to axially oscillate through the bushing 17 and socket assembly 15 while being rotated at a given speed by the cam follower drive gear 20.

Due to the different gear ratios between the first set of gear teeth 21 of a double gear 13 and the cam follower drive gear 20, the rotation of the shaft and the barrel cam gear 22 will be different than the rotation of the barrel cam gear 22 as it meshes with the second set of teeth 23 of the double gear 13.

While the invention has been illustrated and described as embodied in a liquid distributing roller assembly, it is not intended to be limited to the detail shown since various modifications and structural changes may be and without departing in any way from the spirit of the present invention.

What I claim as new and novel and desire to protect by Letters Patent is set forth in the appended claims:

1. A distributing roller assembly for distributing printing ink or a dampening liquid on a driven roller of a printing machine comprising:

(a) a first shaft rotatably carried by said printing machine for rotatably supporting a dual geared drive member;

(b) a second shaft for the distributing roller journaled through a suitable bearing carried by said printing machine extending in a spaced parallel relation to said first shaft;

(c) a barrel cam gear adapted to be driven by said drive member and keyed to said second shaft for rotation therewith;

(d) a second driven gear mounted on said second shaft in spaced relation to said first gear and adapted to be rotated freely of said second shaft;

(e) cam means extending between said barrel cam gear and second driven gear and effective for causing said barrel cam gear and said second shaft to be reciprocally axially moved relative to said second gear and said dual drive gear;

(f) said dual geared drive member having different gear teeth ratios between it and said hub gear and said second driven gear.

2. A distributing roller assembly as defined by claim 1 wherein said cam means comprises a cam track formed in the hub of said barrel cam gear in a cam follower mounted adjacent to the periphery of said second gear and adapted to cooperate with said cam track at a speed of rotation different than the speed of rotation of said first gear.

3. A distributing roller assembly as defned by claim 1 wherein said cam follower comprises a mounting bracket removably attached to the periphery of said second gear and extending axially of the distributing roller shaft and being confined within the gear's periphery of said second gear so as not to interfere with the gear engagement between said dual drive gear and said first and second gears as they are rotated thereby.

* * * * *